United States Patent [19]

Song

[11] Patent Number: 5,029,938

[45] Date of Patent: Jul. 9, 1991

[54] PORTABLE LEISURE TABLE HAVING COLLAPSIBLE SEATING STRUCTURE

[75] Inventor: Dong-Sup Song, Seoul, Rep. of Korea

[73] Assignee: Dong-Il Commerce & Co., Ltd., Seoul, Rep. of Korea

[21] Appl. No.: 495,861

[22] Filed: Mar. 19, 1990

[30] Foreign Application Priority Data

Jul. 29, 1989 [KR] Rep. of Korea ..... 89-11143

[51] Int. Cl.[5] ..... A47B 39/00

[52] U.S. Cl. ..... 297/159; 108/35

[58] Field of Search ..... 297/159, 17; 108/35, 108/112, 113

[56] References Cited

U.S. PATENT DOCUMENTS

| | | | |
|---|---|---|---|
| 3,994,527 | 11/1976 | Nikitits et al. | 108/35 |
| 4,070,057 | 1/1978 | Jones | 297/159 |
| 4,131,311 | 12/1978 | Nikitits et al. | 108/35 |
| 4,653,804 | 3/1987 | Yoo et al. | 297/159 |
| 4,700,987 | 10/1987 | Sraka et al. | 297/159 |
| 4,826,244 | 5/1989 | Choi | 297/159 |
| 4,883,314 | 11/1989 | Sakong | 297/159 |

FOREIGN PATENT DOCUMENTS

| | | | |
|---|---|---|---|
| 647402 | 8/1962 | Canada | 297/159 |
| 1491425 | 7/1967 | France | 297/159 |
| 2546731 | 12/1984 | France | 297/159 |
| 765831 | 1/1957 | United Kingdom | 297/159 |

*Primary Examiner*—Kennth J. Dorner
*Assistant Examiner*—James M. Gardner
*Attorney, Agent, or Firm*—David H. Semmes

[57] ABSTRACT

A portable leisure table having collapsible seating structure is particularly suited for convenient use. The assembly includes planar support members, a round table board (1) having a bow-shaped handle grip (3) and four round-type seats (2), and a collapsible frame support structure. The round table board support includes table supporter rods (5) and table connectors (4). Connecting rods (7) provide partial support for the round-type seats (2) and further provide support for both the table supporter rods (5) and table connectors (4). Each of the round-type seat's support includes: a collapsing control member (6) pivotally connected to connecting plates (8), located at the mid-length of the connecting rods (7); Pair of legs (9) pivotally attached to the connecting rods (7); at the terminal ends thereof; and seat supporting rods (10) pivotally connected to the pair of legs (9) providing the remaining partial support for round-type seats (2). The four round type seats (2) and the collapsible frame support structure compact to be completely contained in a carry package defined by folded halves of the round table board (1) having a bow-shaped handle grip (3).

2 Claims, 4 Drawing Sheets

FIG. 3
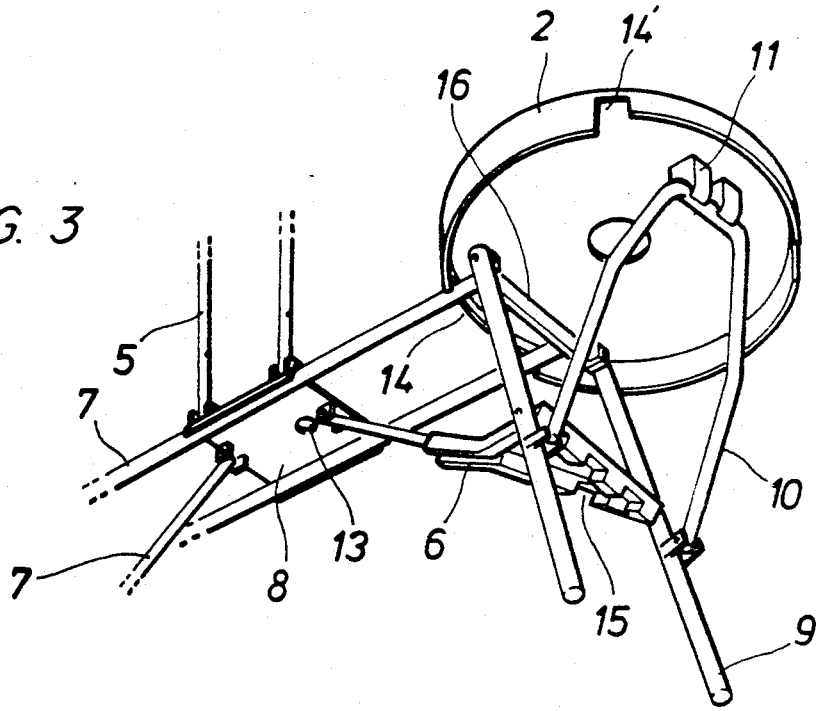
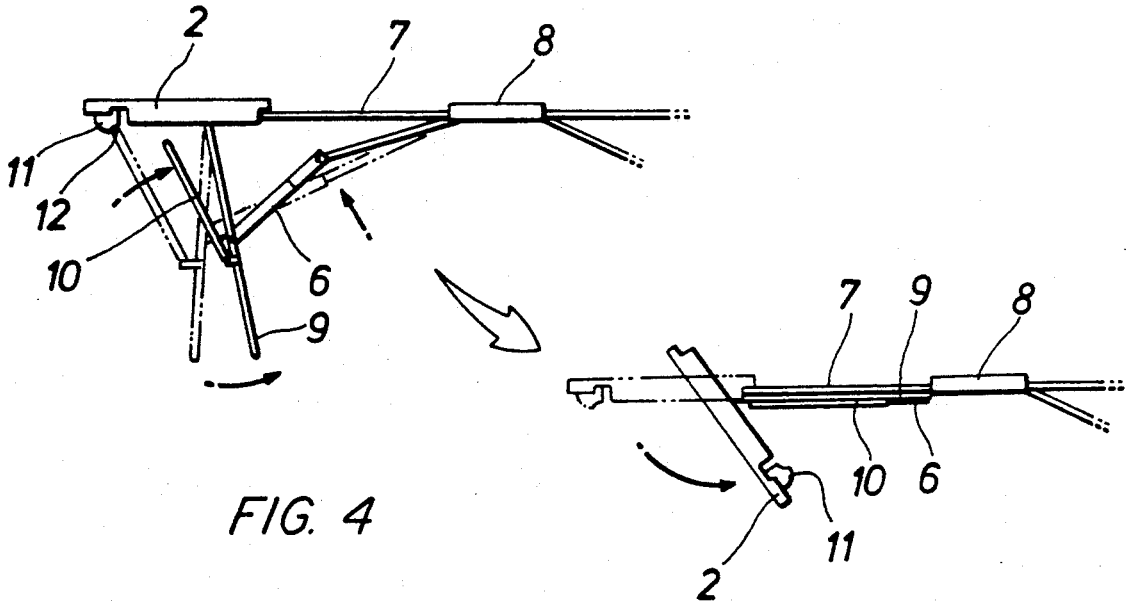
FIG. 4

PORTABLE LEISURE TABLE HAVING COLLAPSIBLE SEATING STRUCTURE

BACKGROUND OF THE INVENTION

This is a PCT of Republic of Korea patent 89-11143 filed Jul. 29, 1989.

The present invention relates to a portable and collapsible leisure table, particularly for a collapsible frame structure of round shaped table and seat, which is light and convenient in seating for securing comparatively wide space between the persons.

In the past, these kinds of table for leisure use, had been proposed and showed as utilizing collapsible or non-collapsible frame structure, however these tables, had been shown as heavy, square-type as in FIG. 8, in general, which had been inconvenient are to narrow-seating space, comparatively large volume, and only opposed seat arrangement.

In this connection, the present inventor tried to make light and round-type table and seat structure for everyone's convenient use, facilitating ease and handling, as well as with small size comparatively. The present invention also is designed to install three parasols, one is on the table and two are on the middle part of the seats of both sides, which are installed for protecting persons against sunray, particularly in summer.

SUMMARY OF THE INVENTION

Therefore, it is a primary object of the present invention to provide an improved collapsible leisure table which utilizes a round-type collapsible table with four round-type seats. And the second object of the present invention is to provide a light table of collapsible structure by means of reducing the volume of seat structure and its accessories, while maintaining supporting structures, for convenient use.

The present invention relates to a collapsible leisure table which is collapsed by a collapsible frame, supported by table supporters which are connected to the bottom surface of the table and the seat, comprising a round table board which has a bow-shaped handle grip at the rim part thereof a, seat which is attachably connected to a connecting rod supported by supporting rod, and legs attachably installed at each bottom surface of the seat, combined with the connecting rod and a collapsible frame for supporting each seat. A seat supporting rod is rotatably jointed to the middle part of the seat legs leg, and a junction element with fitting groove from the bottom face of the seat, and other structures are provided for collapsing and extending the leisure table.

BRIEF DESCRIPTION OF THE DRAWINGS

FIG. 3 is a fragmentary perspective view of the combined and connected parts under the seat of the present invention.

FIG. 4 is a fragmentary schematic view showing the mechanism for of collapsing of the seat in accordance with the present invention.

Figure 1:
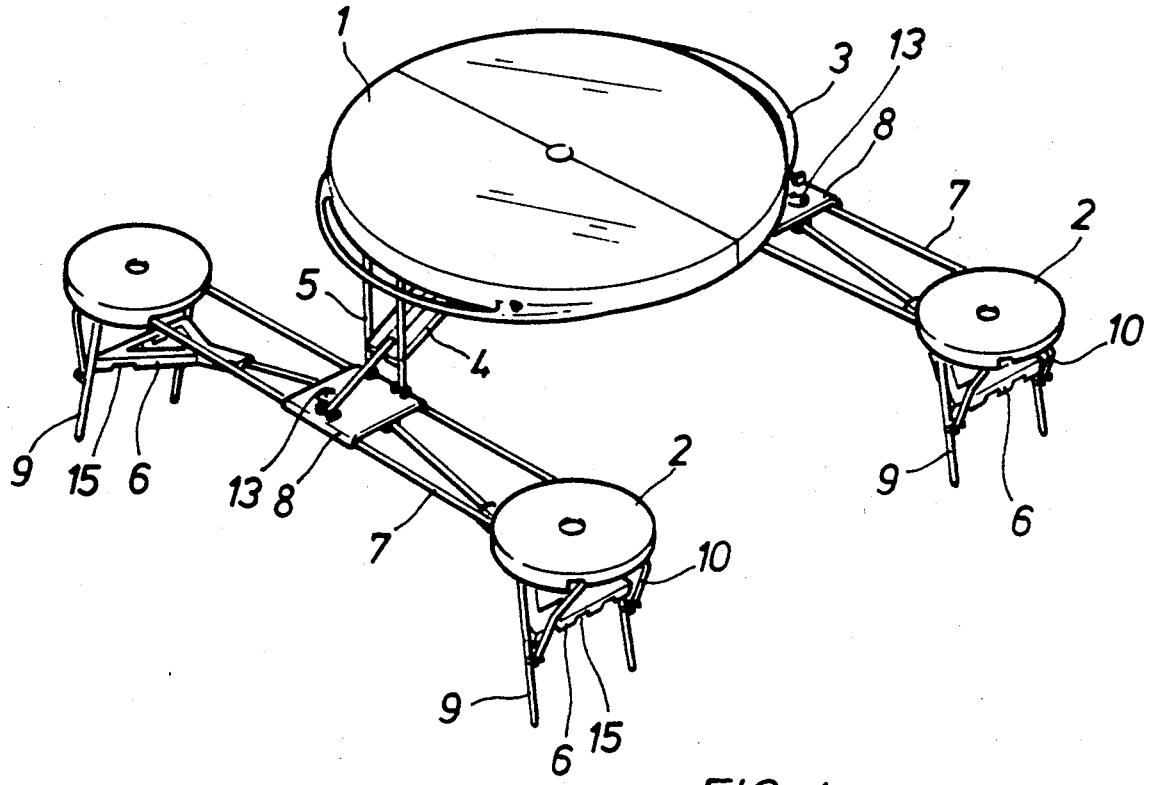
FIG. 1 is a pespective view of embodiment of the present invention showing assembled and expanded leisure table for immediate use.

Referring to the above drawings, the present leisure table mainly consists of round table board (1) which can be collapsed in two parts, has the handle grip (3), round-type seats (2) which are connected to the table board (1) by means of connecting rod (7) and fixing plate (8) for fixing and supporting the intermediate portions of the rod (7) under the table board (1), and connector (4) and the table supporting rod (5) which are collapsibly connected to the above fixing plate (8), and rotatable leg (9) in the joint attached under the seat (2) which has an open-spaced rim around circumference of the seat (2). At the middle part of the leg (9), seat supporting rod (10) is rotatably connected to collapsing control member (6), and the junction element (11) which has spaced grooves (12), projected from the bottom face of the seat (2). Under the seat, the hollow space or groove (12) for receiving the collapsing control members (6) includes fixing plate (8) having hole (13) for inserting parasol P.

The connecting rod (7) and the movable leg (9) are assembled with the collapsing control member (6) such that rod 7 is received in the opened space depression (14) (14'), defined in rim in a direction perpendicular to the connecting rod (7), under the seat (2), for tight, space-shortened collapsing and assembling of the connecting rod seat leg (9) together with seat supporting rod (10). On the bottom of the collapsing control member (6), moulded hollow slot (15) is provided for reducing weight and for inserting the rod (16) for complemental connection to the fixing plate (8), configured complementally to rod 16

In FIG. 1 and in FIG. 3, the expanded state of collapsible table of the present invention is shown such that the table connector (4) and the table supporting rod (5) may control the gap or space between the table board (1) and the seat (2) when expanded, and the legs (9) and the seat (2) may be supported by expanding the collapsing control member (6) and the end part of the seat supporting rod (10) may be put into the groove (12) of the junction element (11) in order to support seat (2). When collapsing seat (2), as is shown in FIG. 4, on the table board, seat supporting rod (10) may be removed from the junction element (11), and then rotated inward and the seat leg (9) may be rotatably moved inward so as to be collapsed on the collapsing control member (6) and on the connecting rod (7) and finally the seat (2) could be closely collapsed on the seat supporting rod (10) which is arranged over the seat leg, below the table board.

Figure 2:
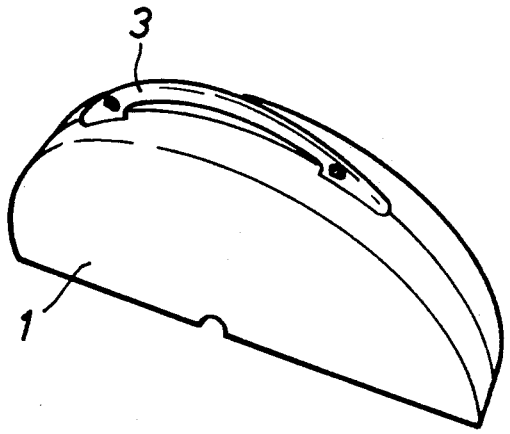
FIG. 2 is a perspective view of the present leisure table which is in state of complete collapse for conveying and for taking in custody and of course carrying.
Figure 5:
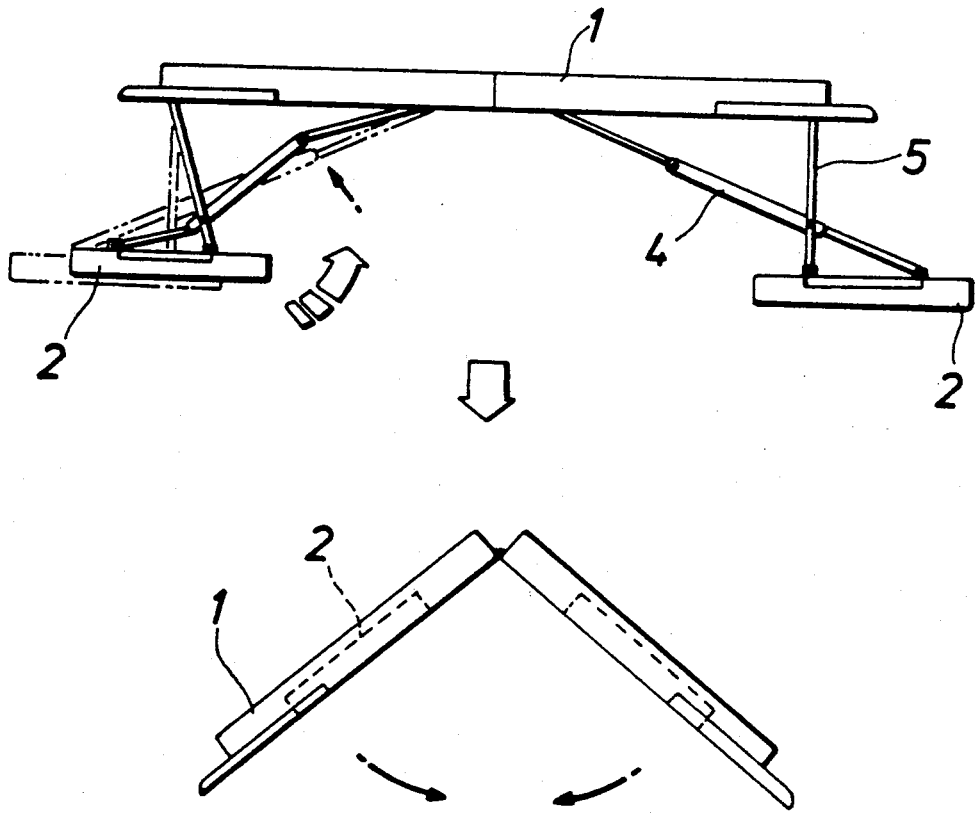
FIG. 5 is an elevational view showing the seat and the table collapsed at the middle part of the table, and the jointing part of the connecting rod.

In short, the present leisure table could be collapsed as a light portable table by collapsing the table connector (4) and the collapsing control member (6), which then, induce the seat (2) to be received under the table board (1), as shown in FIG. 5, and then, finally shaped as bag-type package as is shown in FIG. 2.

Figure 6:
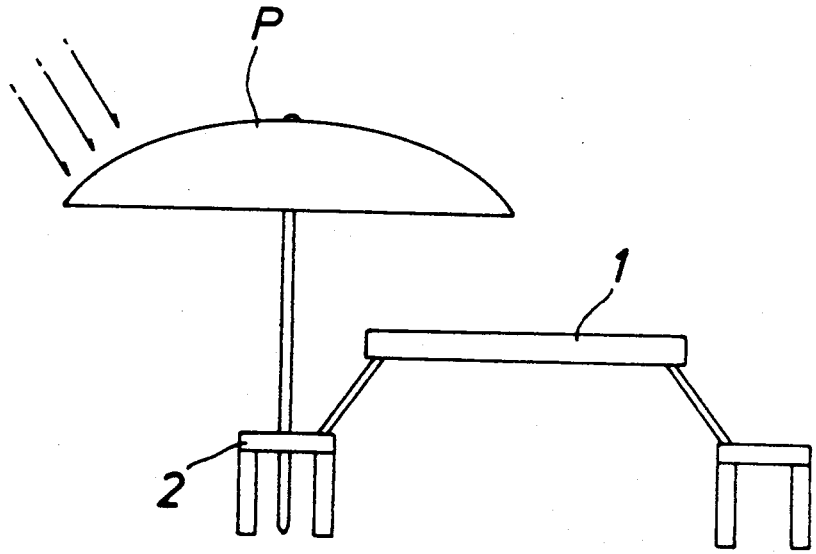
FIG. 6 illustrates a state of installed parasol on the seat of the present invention.

Further, in the present invention, parasol P may be inserted in the through hole (13) of the fixing plate (8)

for preventing irradiation of the direct sun-ray (B) as in FIG. 6.

Figure 7:
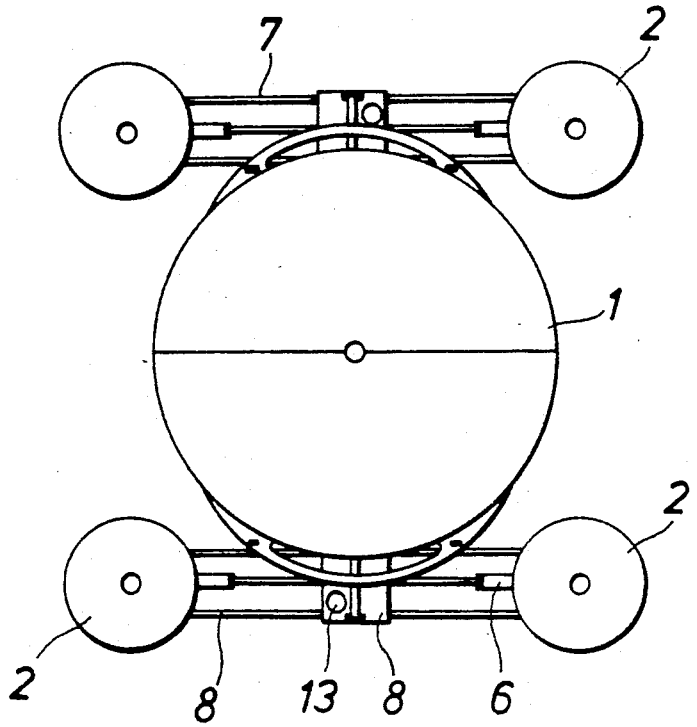
FIG. 7 is a top view of the installed present leisure table which shows round type table, seats and the connecting rod, and fixing plates which connect the table and the seats.
Figure 8:
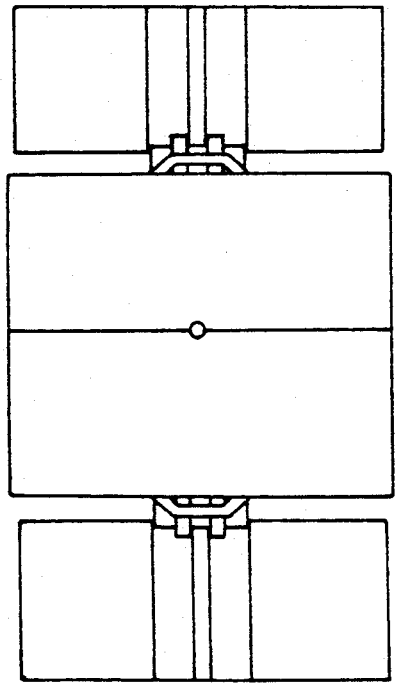
FIG. 8 illustrates a top view of one of the past rectangular portable table for comparison with the present invention.

And the present invention is featured such that each seat is positioned opposite an equidistant from each other seat and from the center of the table with sufficient distance or gap for seating and moving out for person as well as shown beautiful round shape in FIG. 7.

While only one embodiment of the present invention has been shown and described, it will be understood by those persons skilled in the art that many changes and modifications may be made thereunto without departing from the spirit and scope of the present invention.

What claimed is:

1. A portable leisure table and seat assembly which is supported by a table supporting rod (5) interconnecting the bottom surface of the leisure table and the seat assembly comprising:

a) a table board (1) which can be collapsed in two parts and has a bow-type handle grip (3) extending radially outwardly of an edge of said table; and b) a seat (2) assembly, further including:

i) round-type seats (2) attachably connected at the ends of pairs of opposed connecting rods (7), each pair of connecting rods (7) being medially supported by a fixing plate (8);

ii) a pair of seat legs (9) rotatably joined to the bottom part of each said seat, said pair of legs (9) being pivotably connected at their top with the ends of said connecting rods (7) and pivotably connected at their mid-portion with a collapsing control member (6);

iii) a seat supporting rod (10) pivotably joined at its ends to the mid-portion of said seat legs (9) and extending at its other closed end toward said seat (2);

iv) a junction member supported on the underside of each said seat and including a junction element (11) with fitting grove (12) for releasably engaging the closed end of said seat supporting rod (10), so that said seat (2) may be collapsed and received closely in depression (14') defined as a seat groove extending through the rim of said seat (2) and perpendicular to the direction of connecting rod (7), and v) table connectors (4) in the form of an activated link interconnecting each said fixing plates (8) and the bottom surface of said leisure table (1) said collapsing control member (6) and said table connector (4) collapsing, respectively, said seats (2) and said table (1), and said collapsing control member (6) having slot (15) in its rim for engaging connecting rods (7) and for reducing weight.

2. A portable leisure table as in claim 1, each said fixing plate (8) having a through hole (13) for supporting a parasol.

* * * * *